US010337220B2

(12) United States Patent
Bowles

(10) Patent No.: US 10,337,220 B2
(45) Date of Patent: Jul. 2, 2019

(54) TOOL CHEST LOCKING MECHANISM

(71) Applicant: Ridge Tool Company, Elyria, OH (US)

(72) Inventor: Richard R. Bowles, Solon, OH (US)

(73) Assignee: Ridge Tool Company, Elyria, OH (US)

( * ) Notice: Subject to any disclaimer, the term of this patent is extended or adjusted under 35 U.S.C. 154(b) by 0 days.

(21) Appl. No.: 15/805,559

(22) Filed: Nov. 7, 2017

(65) Prior Publication Data

US 2018/0238088 A1 Aug. 23, 2018

Related U.S. Application Data

(60) Provisional application No. 62/460,159, filed on Feb. 17, 2017.

(51) Int. Cl.

| | |
|---|---|
| ***E05C 9/04*** | (2006.01) |
| ***E05B 65/52*** | (2006.01) |
| ***E05B 67/38*** | (2006.01) |
| ***E05B 1/00*** | (2006.01) |
| ***E05B 13/00*** | (2006.01) |

(52) U.S. Cl.

CPC ..... *E05C 9/047* (2013.01); *E05B 1/00* (2013.01); *E05B 13/002* (2013.01); *E05B 65/523* (2013.01); *E05B 67/383* (2013.01); *E05C 9/043* (2013.01)

(58) Field of Classification Search

CPC . E05C 9/043; E05C 9/047; E05B 1/00; E05B 13/002; E05B 65/523; E05B 67/383

See application file for complete search history.

(56) References Cited

U.S. PATENT DOCUMENTS

| | | | | |
|---|---|---|---|---|
| 3,334,933 | A * | 8/1967 | Ehlers | E05C 1/04 292/148 |
| 4,290,281 | A * | 9/1981 | Knaack | E05B 67/38 70/159 |
| 5,058,937 | A * | 10/1991 | Miehe | E05B 13/10 292/165 |
| 5,076,078 | A * | 12/1991 | Weger, Jr. | E05B 67/38 292/104 |
| 5,600,921 | A * | 2/1997 | Vardaro | E05C 9/043 49/379 |
| 6,065,314 | A * | 5/2000 | Nicholson | E05B 67/383 292/218 |
| 6,077,427 | A * | 6/2000 | Burrows | B01D 61/08 210/198.1 |
| 6,772,613 | B2 * | 8/2004 | Webb | B25H 3/02 292/148 |
| 7,343,762 | B1 * | 3/2008 | East | E05B 13/108 292/36 |
| 8,096,152 | B2 * | 1/2012 | Wagh | E05B 67/383 292/148 |
| 9,663,278 | B1 * | 5/2017 | Daws, II | E05B 63/244 |

(Continued)

FOREIGN PATENT DOCUMENTS

| | | |
|---|---|---|
| EP | 1334252 | 8/2003 |
| EP | 2398985 | 12/2011 |

*Primary Examiner* — Hanh V Tran

(74) *Attorney, Agent, or Firm* — Mark E. Bandy; Rankin, Hill & Clark LLP

(57) ABSTRACT

A locking system is described that is intuitive to use and provides a high degree of security. The locking system is a multipoint locking system and includes a plurality of components that provide engagement between components. Also described are cabinets and enclosures using the locking system.

32 Claims, 15 Drawing Sheets

(56) References Cited

U.S. PATENT DOCUMENTS

| | | | | |
|---|---|---|---|---|
| 2002/0108410 | A1* | 8/2002 | Webb | B25H 3/02 70/159 |
| 2007/0046032 | A1* | 3/2007 | Moore | E05B 13/001 292/36 |
| 2007/0080542 | A1* | 4/2007 | Ookawara | E05B 83/30 292/36 |
| 2007/0240462 | A1* | 10/2007 | James | B25H 3/02 70/159 |
| 2008/0110893 | A1* | 5/2008 | Cowie | B65D 19/08 220/324 |
| 2010/0244641 | A1* | 9/2010 | Bergesch | E05B 65/02 312/326 |
| 2013/0088133 | A1* | 4/2013 | Booth | A47B 47/02 312/326 |
| 2015/0008680 | A1* | 1/2015 | Suzuki | B60R 7/06 292/32 |
| 2015/0159410 | A1* | 6/2015 | Stallbaumer | E05B 65/1006 292/139 |
| 2015/0259956 | A1* | 9/2015 | Frederick | E05B 17/2038 312/333 |
| 2016/0201379 | A1* | 7/2016 | Dutra | E05G 1/005 312/204 |
| 2017/0233155 | A1* | 8/2017 | Daws, II | E05B 63/244 220/324 |
| 2018/0163441 | A1* | 6/2018 | Brown | E05B 63/0065 |

* cited by examiner

TOOL CHEST LOCKING MECHANISM

CROSS REFERENCES TO RELATED APPLICATIONS

This application claims priority from US provisional application No. 62/460,159 filed Feb. 17, 2017.

FIELD

The present subject matter relates to locking systems and cabinets and enclosures utilizing such locking systems.

BACKGROUND

Cabinets and enclosures are routinely used to store and protect their contents which may be valuable, dangerous if used incorrectly, and/or contain confidential information. In order to safeguard the contents of cabinets and enclosures, a wide array of locking systems have been devised.

A typical locking system is configured to govern access to a cabinet by selectively enabling opening of a door, lid, or drawer of the cabinet. Such locking systems often include one or more members that can be selectively positioned to enable the door, lid, or drawer to open; or positioned to prevent such opening. Such positioning can be performed by a rotatable handle or other member for example. The positionable member(s) are typically in the form of metal bars or rods which engage the door, lid, or drawer with the cabinet to prevent opening; and disengage the door, lid, or drawer from the cabinet to enable opening.

Although the use of a single member for selectively engaging a door, lid, or drawer may be suitable for many applications, "two point" and "three point" locking systems have been developed which provide greater security against tampering and unauthorized opening of the door, lid, or drawer due to locking engagement occurring at more than one location. However, the degree of security provided by such systems varies greatly. In addition, the manner by which many of these two and three point systems are opened and/or closed is not readily intuitive in many instances.

Although satisfactory in many respects, a need exists for a multipoint locking system which is intuitive to use, yet provides a relatively high level of security.

SUMMARY

The difficulties and drawbacks associated with previous approaches are addressed in the present subject matter as follows.

In one aspect, the present subject matter provides a lockable enclosure comprising an enclosure defining an opening providing access to an interior of the enclosure. The enclosure includes a panel movably affixed to the enclosure and selectively positionable over the opening to govern access to the interior, and a chamber sized and shaped to fittingly receive a padlock. The lockable enclosure also comprises a locking system including a rotatable actuator and a sliding bolt engaged with the actuator such that upon one of (i) at least partial rotation of the actuator, and (ii) longitudinal displacement of the sliding bolt, the other of (i) and (ii) occurs. The locking system is positionable between a locked position and an unlocked position. At the locked position the sliding bolt engages the enclosure and the panel and prevents selective positioning of the panel to preclude access to the interior of the enclosure, and at the unlocked position the sliding bolt is free from engagement with at least one of the enclosure and the panel to allow access to the interior of the enclosure. Upon placement of an unlocked padlock in the chamber, positioning the locking system to the locked position, and locking the padlock, the locking system is precluded from being positioned to an unlocked position due to contact between the actuator and the padlock.

In another aspect, the present subject matter provides a lockable enclosure comprising an enclosure having a frame member and defining an interior and an opening providing access to the interior of the enclosure. The lockable enclosure also comprises a panel having an engagement member. The panel is movably affixed to the enclosure and positionable between (i) a closed position in which the panel blocks access through the opening to the interior of the enclosure, and (ii) an open position in which the interior of the enclosure can be accessed through the opening. The frame member of the enclosure defines a first aperture. The engagement member of the panel defines a second aperture. The lockable enclosure also comprises a locking system including an actuator rotatable about a center axis. The actuator defines a first end and a second end such that the center axis is located between the first end and the second end. The actuator includes an outwardly extending tang and a finger projecting in a direction generally opposite from the tang. Both the tang and the finger disposed proximate the first end of the actuator. The locking system also includes a sliding bolt affixed to the actuator and engageable with the frame member of the enclosure and the engagement member of the panel. The locking system is positionable between a locked position and an unlocked position. At the locked position the actuator is rotatably positioned such that the sliding bolt extends through both of the first aperture defined in the frame member and the second aperture defined in the engagement member, and at the unlocked position the actuator is rotatably positioned such that the sliding bolt is free from at least one of the first aperture and the second aperture.

In still another aspect, the present subject matter provides a locking system comprising a rotatable actuator and a sliding bolt engaged with the actuator such that upon partial rotation of the actuator, the sliding bolt is longitudinally displaceable between an extended position and a retracted position. The locking system also comprises a chamber sized and shaped to fittingly receive a padlock. The chamber is positioned proximate the actuator. The locking system is positionable between a locked position and an unlocked position, wherein at the locked position the sliding bolt is longitudinally positioned to the extended position, and at the unlocked position the sliding bolt is longitudinally positioned to the retracted position. Upon placement of an unlocked padlock in the chamber, positioning the locking system to the locked position, and locking the padlock, the locking system is precluded from being positioned to an unlocked position due to contact between the actuator and the padlock.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
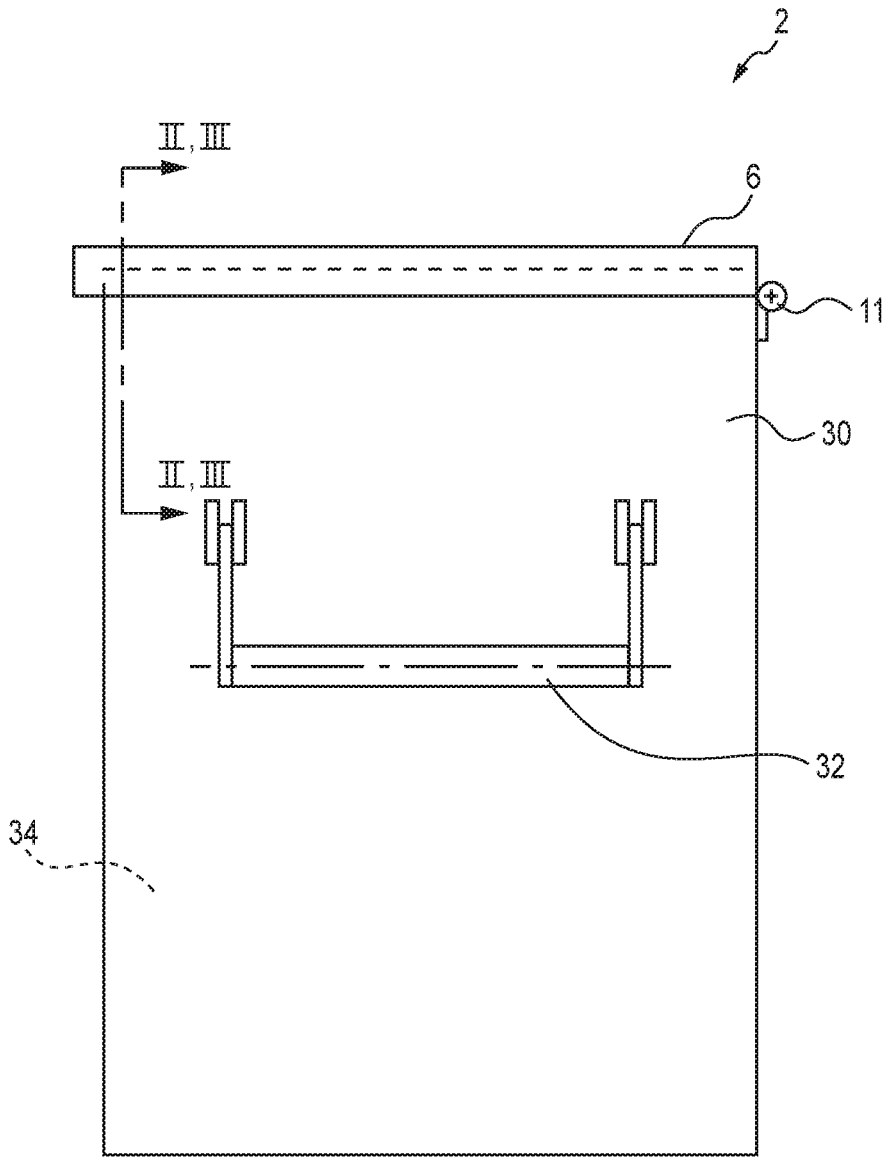
FIG. 1 is a schematic illustration of a cabinet having a multipoint locking system in accordance with the present subject matter.

Generally, the referenced figures depict lockable enclosures and multipoint locking systems which are particularly useful for incorporation in large job site tool storage chests. A side view of an embodiment of a tool chest or cabinet 2 in accordance with the present subject matter is presented in FIG. 1. The tool chest 2 includes a positionable lid or panel 6 that when opened, enables access to an interior 34 of the chest. The chest 2 includes one or more walls 30 which together with the lid 6 define the interior 34. The chest 2 typically also includes one or more handles 32.

Figure 2:
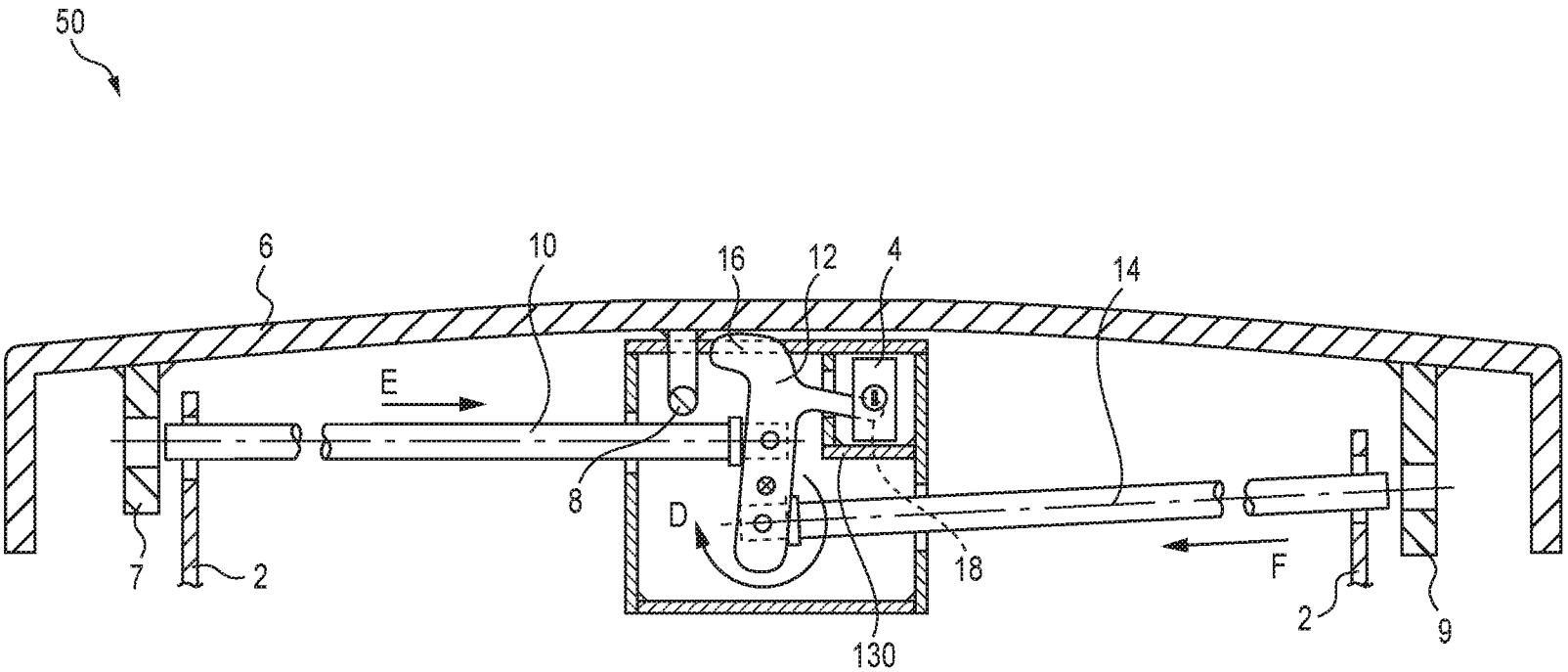
FIG. 2 is a schematic cross sectional view taken across line II-II in FIG. 1 showing an embodiment of the multipoint locking system in an unlocked position.
Figure 3:
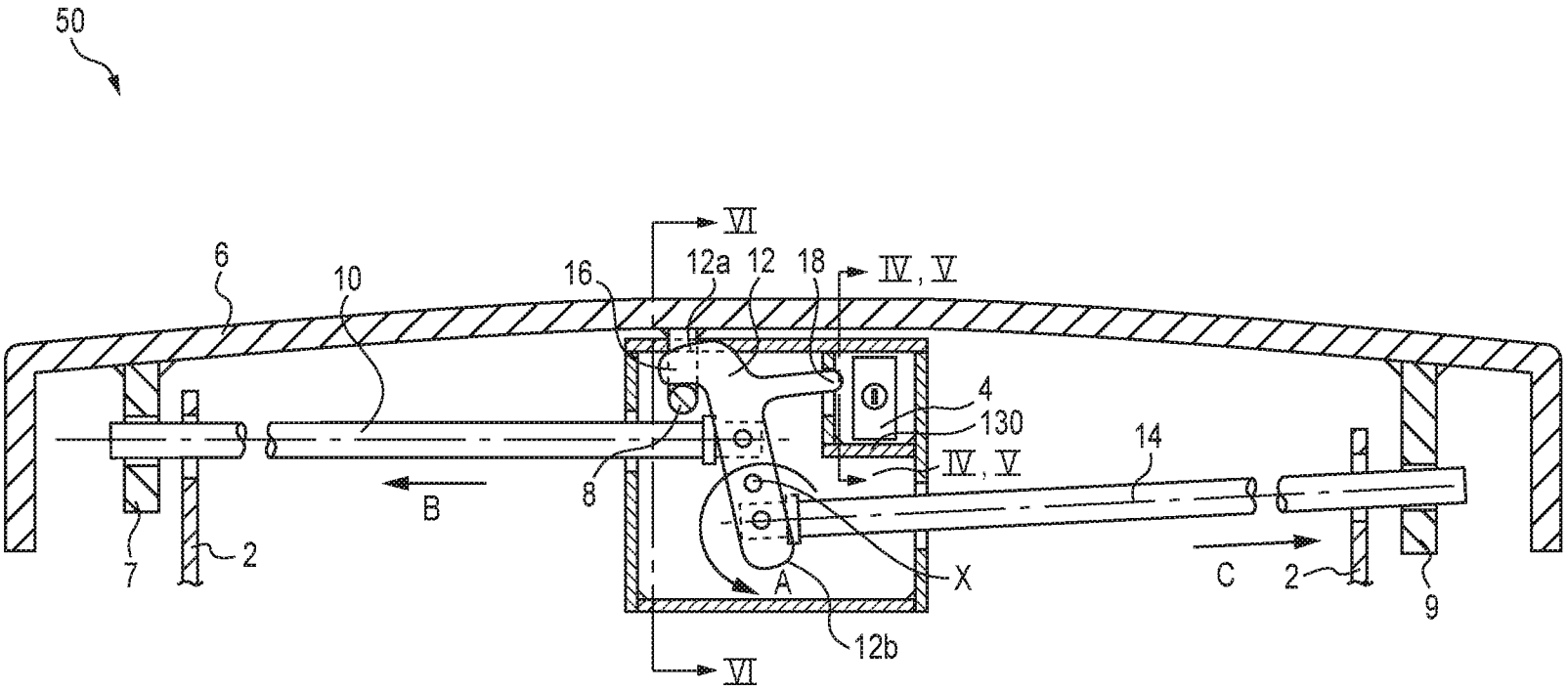
FIG. 3 is a schematic cross sectional view taken across line III-III in FIG. 1 showing the multipoint locking system in a locked position.
Figure 5:
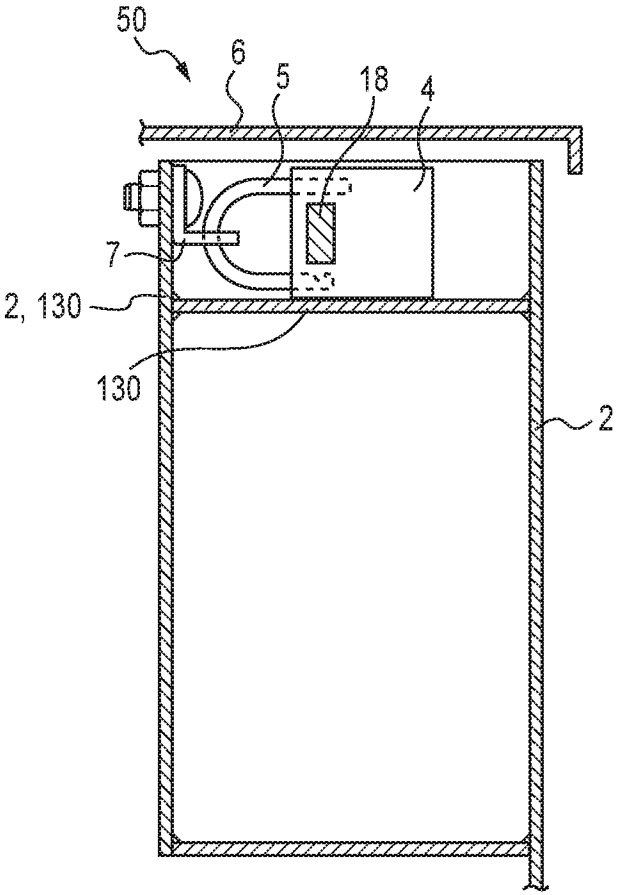
FIG. 5 is a schematic cross sectional view taken across line V-V in FIG. 3 showing a portion of the multipoint locking system in a locked position.
Figure 4:
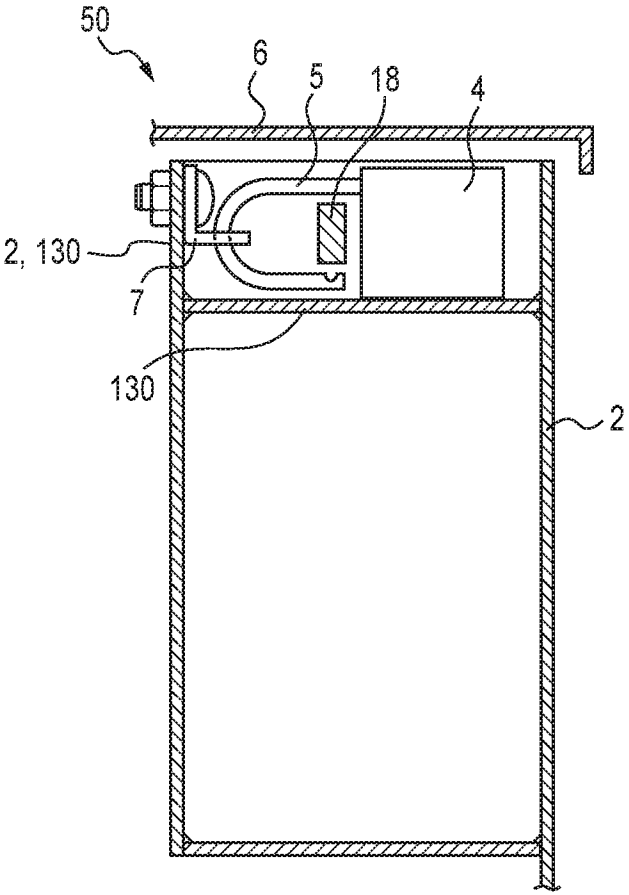
FIG. 4 is a schematic cross sectional view taken across line IV-IV in FIG. 3 showing a portion of the multipoint locking system in an unlocked position.

Referring to FIGS. 2 and 3, an embodiment of a multipoint locking system 50 incorporated in the chest 2 in accordance with the present subject matter is shown in a partial sectional view. FIG. 2 shows the system 50 in an unlocked position or state and FIG. 3 shows the same system 50 in a locked position or state. As described in greater detail herein, the chest 2 and/or the locking system include a chamber 130 and a padlock 4 disposed therein. In order to lock the tool chest 2, a user moves the locking system 50 by at least partially rotating an actuator 12 in a counter-clockwise (CCW) direction shown by arrow A as depicted in FIG. 3. When the actuator 12 is rotated in the direction of arrow A, a first slide bar 10 or sliding bolt as periodically referred to herein, moves to the left as illustrated by arrow B and engages a flange 7 affixed to the lid 6 to provide a point of latching. Simultaneously, a second slide bar 14 moves to the right as shown by arrow C and engages a flange 9 affixed to lid 6 to provide a second point of latching. In many embodiments, the actuator includes an outwardly extending finger 12. Upon rotating actuator 12, the finger 16 engages a catch bracket 8. The bracket 8 is affixed to the underside of the lid 6 or other portion of the tool chest 2 thereby providing a third point of latching. In many embodiments, the actuator includes an outwardly extending tang 18. If the actuator includes the noted finger 16, the tang 18 projects in an opposite direction from that of the finger 16. When the actuator 12 is rotated in the direction of arrow A, the extended tang 18 on the rotating actuator 12 moves in a direction away from the main body of a padlock 4. This action allows clearance so that the padlock 4 may be locked or otherwise positioned to a locked position. As seen in FIGS. 4 and 5, a shackle 5 of padlock 4 can be attached to the structural part of the lower portion of the chest 2 and/or the chamber 130 by a bracket 7 which is bolted or affixed in place.

Once the padlock 4 has been locked, the main body of the padlock 4 moves into a position where it prevents the actuator 12 from rotating in a clockwise (CW) direction shown as arrow D in FIG. 2 which would be necessary to disengage the three latching points. Linear motion of the slide bars 10, 14 is prevented due to interference and/or contact with the padlock 4 and specifically the main body of the padlock. Upon unlocking the padlock 4, the main body of the padlock 4 moves to the position shown in FIG. 4, thereby allowing movement of the tang 18 of the actuator 12 when the actuator is rotated in the direction of arrow D in FIG. 2. Such movement of the actuator 12 displaces the slide bar 10 in the direction of arrow E, and slide bar 14 in the direction of arrow F, thereby unlocking the chest 2. Specifically, after unlocking the padlock 4, the tang 18 can then be received in the region between the shackle 5 and the main body of the padlock 4.

Figure 6:
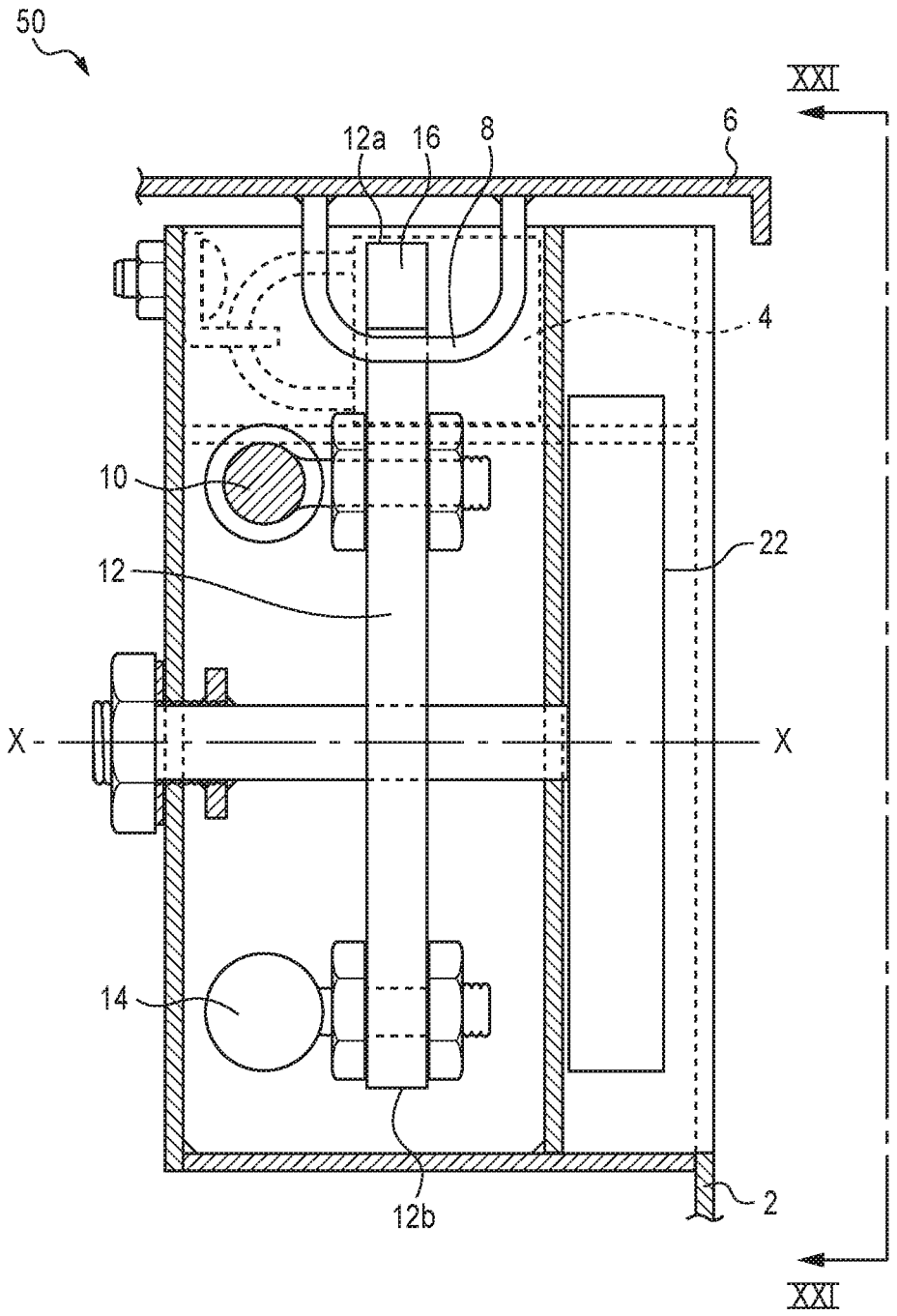
FIG. 6 is a schematic cross sectional view taken across line VI-VI in FIG. 3 showing additional aspects of the multipoint locking system.
Figure 8:
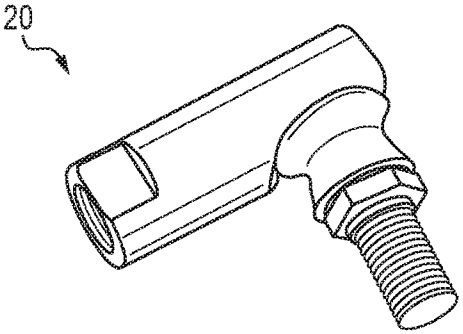
FIG. 8 is a perspective view of a representative ball joint rod end component that can be used in certain versions of the multipoint locking systems.

Specifically, and with reference to FIGS. 2, 3, and 6, in certain versions of the present subject matter, the actuator 12 defines a first end 12*a* and a second end 12*b* and is rotatable about a center axis X which is located between the ends 12*a*, 12*b*. The actuator includes an outwardly extending tang 18 and a finger 16 projecting in a direction generally opposite from the tang 18. Both the tang 18 and the finger 16 are disposed proximate the first end 12*a* of the actuator 12. The first slide bar 10 is affixed to the actuator 12 at a location proximate the first end 12*a*. And the second slide bar 14 is affixed to the actuator 12 at a location proximate the second end 12*b*. In many embodiments, it is envisioned that the slide bar 10 and the slide bar 14 are attached to the rotating actuator 12 via a commercially available ball joint such as for example the component 20 depicted in FIG. 8. This configuration results in an assembly in which upon at least partial rotation of the actuator about axis X, the first slide bar 10 is longitudinally displaced, i.e., the bar 10 is either extended or retracted; and the second slide bar 14 is also longitudinally displaced, i.e., either extended or retracted, but in a direction opposite that of the first slide bar 10. And, the assembly is configured such that upon extension of the first slide bar 10, i.e., such as when locking the system 50, the second slide bar 14 is also extended. Upon unlocking the system 50, both of the first and the second slide bars 10, 14 are retracted.

The present subject matter described is illustrated as incorporated in tool chests which contain a lid that pivots about a horizontal axis hinge such as hinge 11 depicted in FIG. 1. However, it is envisioned that a substantially similar multipoint locking system could be incorporated in tool chests that have doors or panels that open about a vertically oriented axis hinge. This would provide all of the same benefits, i.e., three point mounting, improved security, etc., as previously described regarding the tool chest 2.

Figure 7:
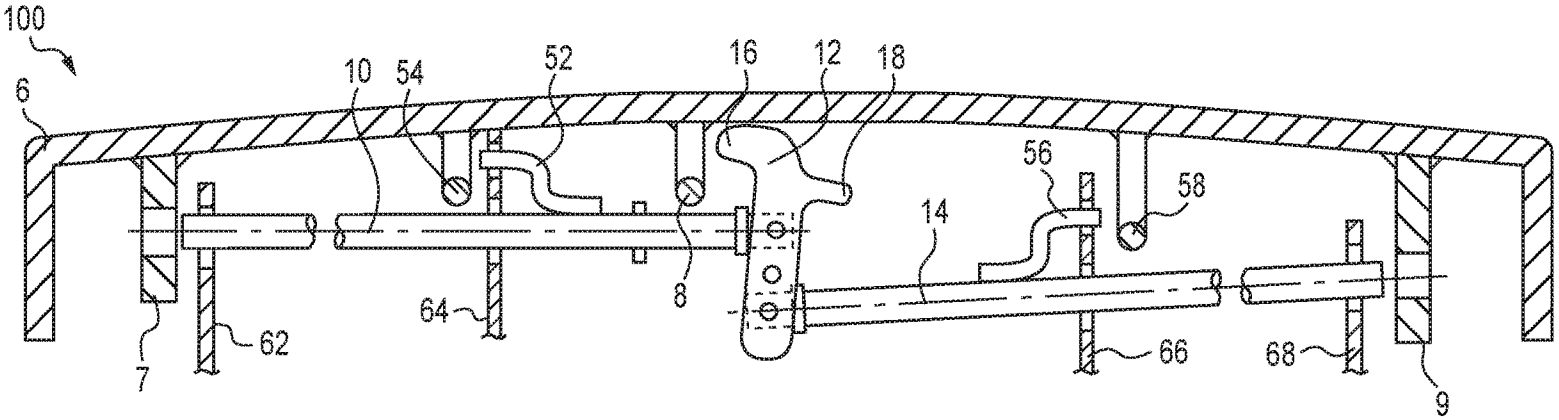
FIG. 7 is a schematic cross sectional view of another embodiment of a multipoint locking system in accordance with the present subject matter.

Another embodiment of the multipoint locking system is particularly useful for very large tool chests in which the width of the lid is relatively large, e.g., greater than about 48 inches. It would be possible to modify the locking system 50 with additional hooks or engagement members 52 and 56 affixed to or formed with the slide bars 10, 14 as seen in FIG. 7. Any number of additional latching points can be incorporated in the multipoint locking system. These hooks 52, 56 engage receiving catches 54 and 58 affixed to the lid 6 as illustrated. In this particular embodiment, the sliding bars 10, 14 are configured to pass through stationary members 62, 64, 66, and 68 affixed to the chest 2 or its frame to secure the lid 6 in the locked position.

Figure 21:
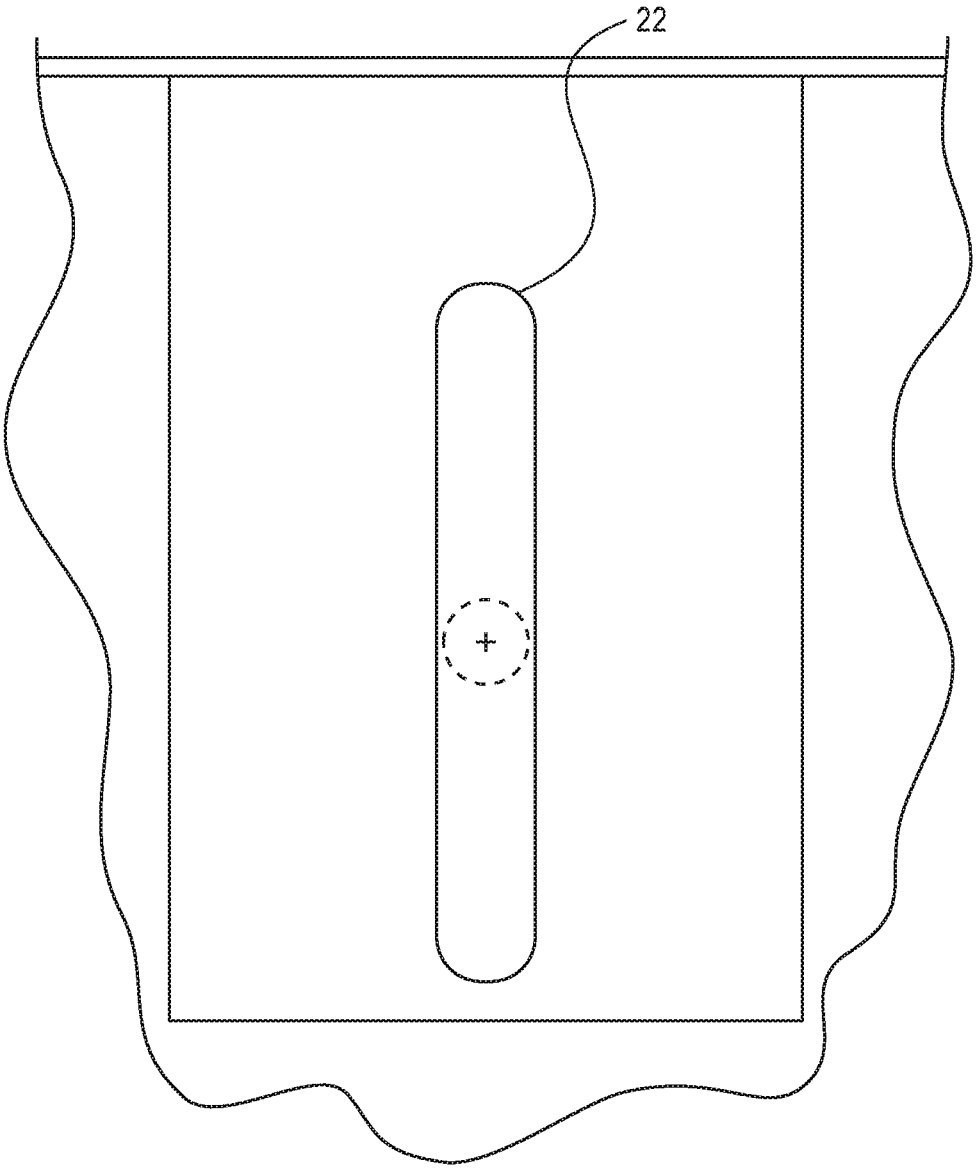
FIG. 21 is a schematic front view of a rotatable handle associated with the multipoint locking system depicted in FIG. 6.

In certain embodiments, the rotating or rotatable handle 22 is accessible through an aperture, cutout, or other opening, which could be recessed, provided along a region such as for example a front region, of the tool chest. A user could grasp the rotatable handle 22 and rotate the handle 22 either in a clockwise direction or in a counterclockwise direction to engage or disengage the latching mechanism. In this embodiment, such a configuration allows opening the locking mechanism through a rotational motion instead of a linear motion. FIG. 21 is a schematic view taken from line XXI-XXI in FIG. 6 showing a rotatable handle 22 engaged with the actuator, and the handle 22 being accessible from the exterior of the tool chest or enclosure.

If desired, the rotating handle 22 used for locking and/or unlocking the system could be eliminated and a bar could extend from one or both of the slide bars 10 or 12 to allow a linear sliding action to open the latch.

It is envisioned that even though the slide bars 10 and 12 are illustrated as having a round cross section, they could alternatively be constructed from stock such as steel bars having square, rectangular, hexagonal or other shape(s) cross sections.

Figure 9:
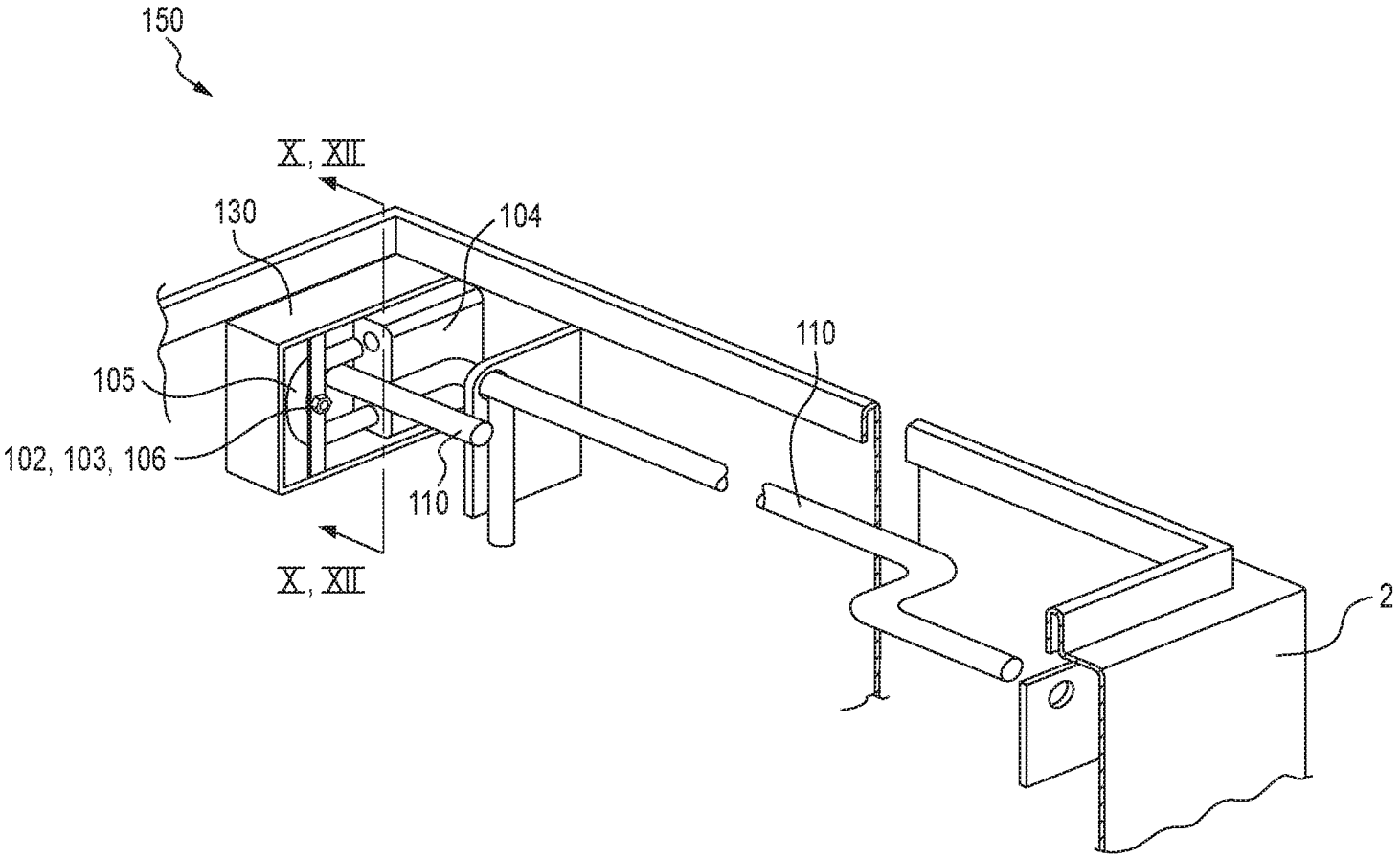
FIG. 9 is a perspective view of another multipoint locking system in accordance with the present subject matter.
Figure 11:
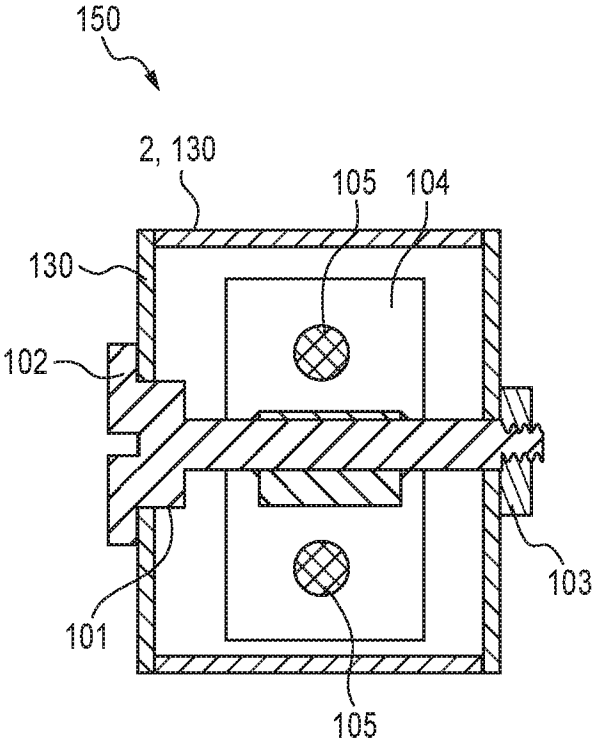
FIG. 11 is a schematic cross sectional view taken across line XI-XI in FIG. 10 showing a portion of the multipoint locking system.
Figure 10:
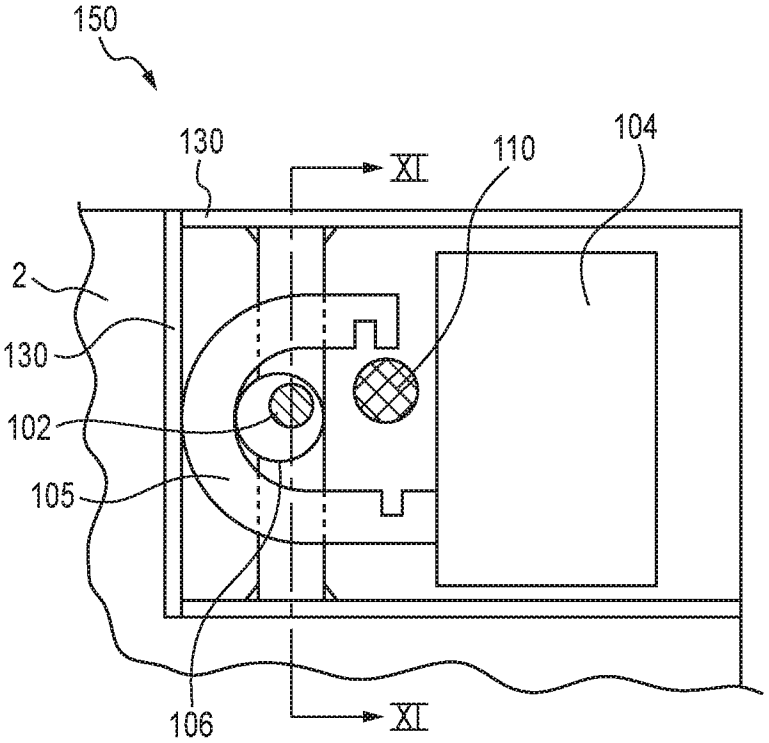
FIG. 10 is a schematic cross sectional view taken across line X-X in FIG. 9 showing a portion of the multipoint locking system in an unlocked position.

Another embodiment of a multipoint locking system 150 having a cammed engagement member is shown in FIGS. 9-11. In order to further illustrate the lock mounting arrangement, a perspective cross sectional view is shown in FIG. 9 and the illustration in FIG. 10 shows the lock mounting details. An additional cross sectional view is shown to further describe the lock mounting which is shown in FIG. 11.

FIG. 9 illustrates the multipoint locking system 150 in which the movement of a sliding bar 110 is blocked by the main body of a padlock 104 when the padlock 104 is in the locked position. FIG. 9 shows the unlocked position in which the sliding bar 110 is free to pass by the padlock 104 as shown. Specifically, the sliding bar 110 can be positioned within a region between the shackle 105 and the main body of the padlock 104. The illustration also shows a box shaped chamber or weldment 130 that contains and generally encloses the padlock 104.

Referring to FIG. 10, the padlock 104 is shown in the unlocked position as can be seen since shackle 105 is disengaged from the main body of the padlock. In this illustration, an engagement member 102 which is rotatable and contains an eccentric cam portion 106 is shown. The engagement member 102 has a slotted head, although the present subject matter includes nearly any form or shape for the member 102 and/or its head. This member 102 includes a shoulder portion 101 which passes through weldment wall 130. The member 102 is positioned such that the eccentric cam portion 106 passes through the shackle 105 and specifically between the shackle 105 and the main body of the padlock 104. Once properly positioned, the slotted head of the member 102 is rotated to cause the eccentric cam portion 106 to rotate and thus frictionally engage or "pinch" the shackle 105 between the eccentric portion 106 and the weldment wall 130. This action takes up any clearance between the engagement member 102 and the shackle 105 to prevent movement of the shackle 105. Once properly positioned, a jam nut 103 can be tightened to secure member 102 in the correct orientation to keep the shackle 105 securely positioned against the weldment wall 130. A similar padlock securing arrangement could also be incorporated into the padlock mounting shown in FIGS. 2 through 6 in an alternative embodiment which is not shown.

Figure 13:
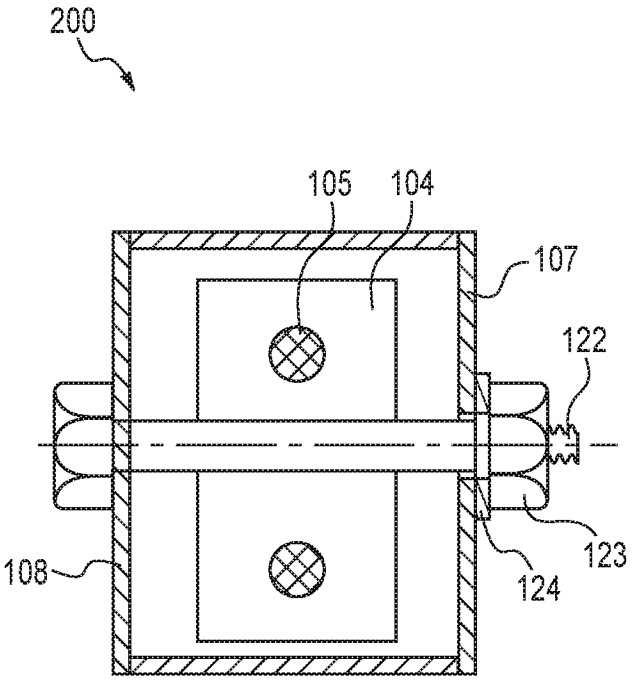
FIG. 13 is a schematic view taken across line XIII-XIII in FIG. 12 showing a portion of the noted multipoint locking system.
Figure 12:
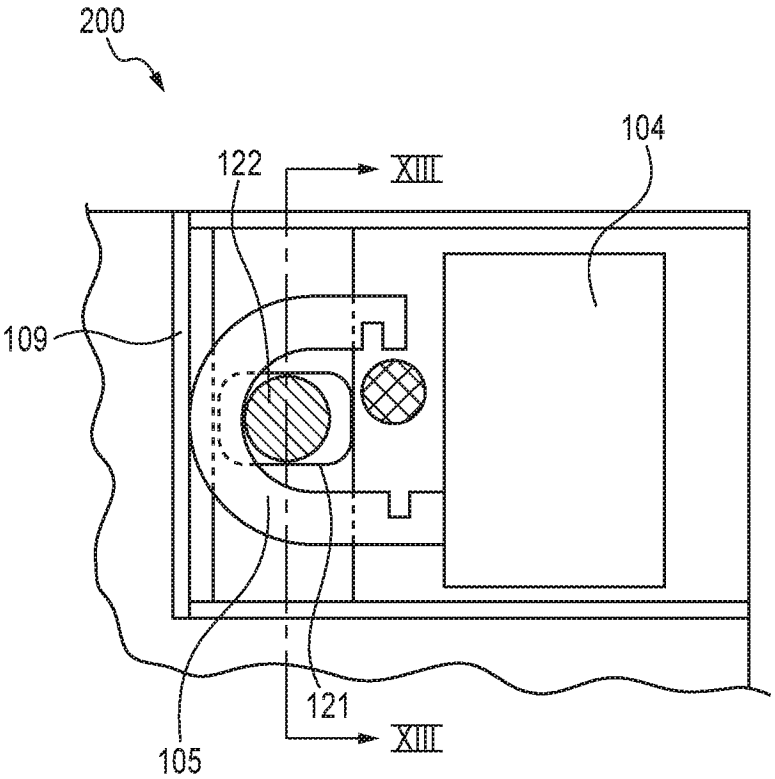
FIG. 12 is a schematic cross sectional view taken across line XII-XII in FIG. 9 showing a portion of another embodiment of the multipoint locking system.

An alternate embodiment of the multipoint locking system is shown in FIGS. 12 and 13 as locking system 200. In this alternate embodiment, the member 102 with eccentric portion 106 is replaced by a longitudinal member 122 with no eccentric portion. This embodiment operates in a similar manner in which the longitudinal member 122 captures the shackle 105 against the wall of the chamber or weldment 130 to prevent movement of the padlock 104. In this embodiment, the longitudinal member 122 can be situated in slotted apertures 121 defined in walls 107 and 108 of the weldment. The slots 121 allow movement of the longitudinal member 122 when a nut 123 and a washer 124 are in a loosened state. The longitudinal member 122 can be positioned through the two slots 121 and through shackle 105 and then moved horizontally in a manner such that the shackle 105 contacts wall 109 of the weldment 130. Once properly adjusted, the nut 123 can be tightened to thereby retain the longitudinal member 122 in the proper orientation in the slots 121 such that the shackle 105 is held securely against wall 109. As with the padlock mounting shown in FIGS. 10 and 11, this padlock mounting arrangement is possible in an alternative embodiment to the locking mechanism shown in FIGS. 2 to 6. This embodiment is not illustrated.

Figure 14:
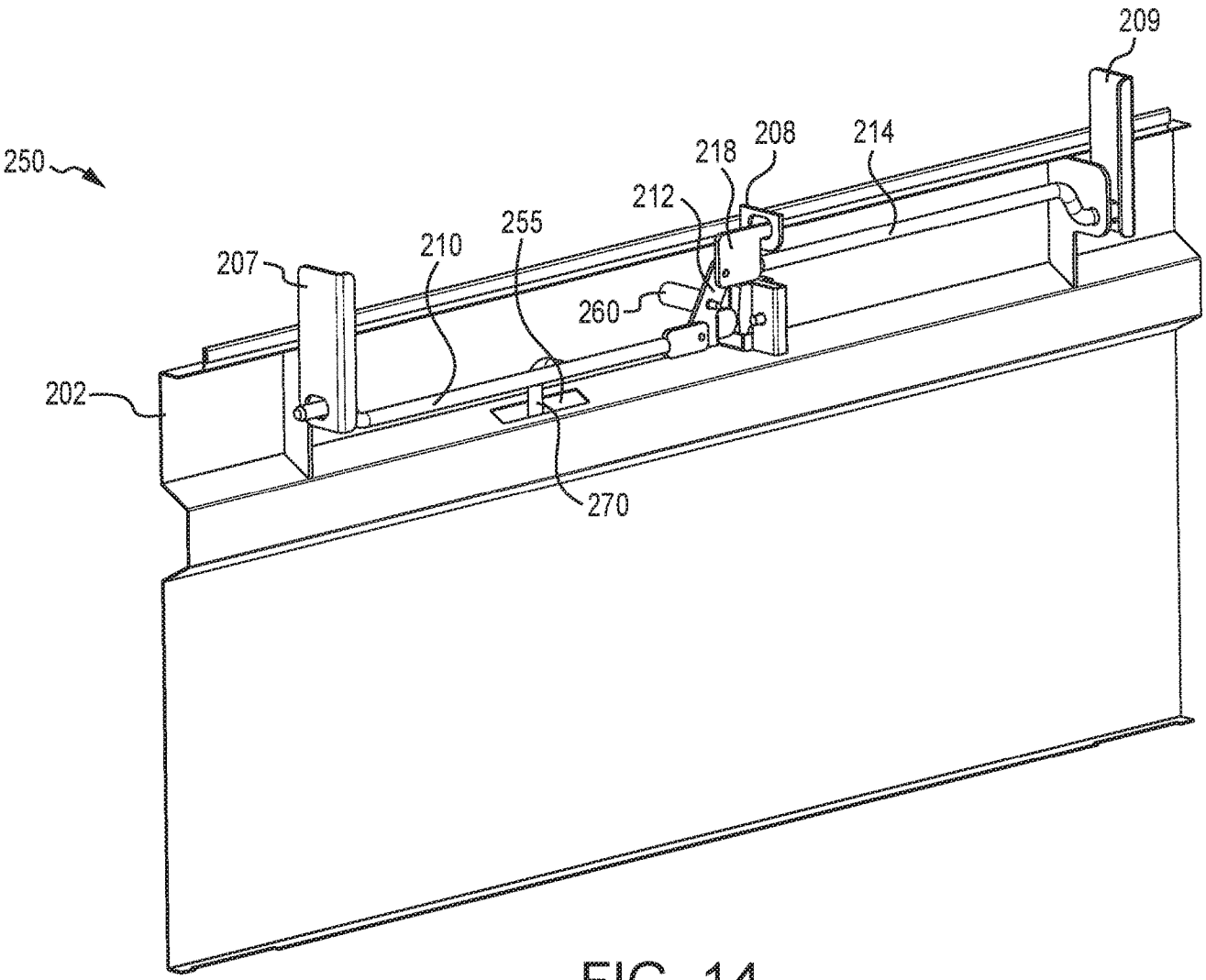
FIG. 14 is a schematic perspective view of another embodiment of a multipoint locking system in accordance with the present subject matter.

FIG. 14 is a perspective view of another embodiment of a multipoint locking system in accordance with the present subject matter. Specifically, a multipoint locking system 250 in accordance with the present subject matter is shown. The locking system 250 is depicted incorporated within a chest 202. A portion of an interior face 204 of a panel or sidewall of the chest 202 is depicted in FIG. 14. The locking system 250 generally comprises a first slide bar 210 or sliding bolt, a second slide bar 214 or sliding bolt, an actuator 212, and a tang 218. In many versions, the actuator 212 is moveably coupled to the first and second sliding bars 210, 214 such that linear displacement (or longitudinal movement along the axis of the bar) of one of the bars 210, 214 causes rotation of the actuator 212, and linear displacement of the other bar. This engagement and manner of movement is described in greater detail herein. In addition, the tang 218 is also moveably coupled to the actuator 212 as will be understood from the referenced figures. It will be understood that the present subject matter includes a variety of coupling assemblies between these components. And, it is contemplated that the tang 218 could be integral with the actuator 212 and not moveably coupled thereto.

Figure 15:
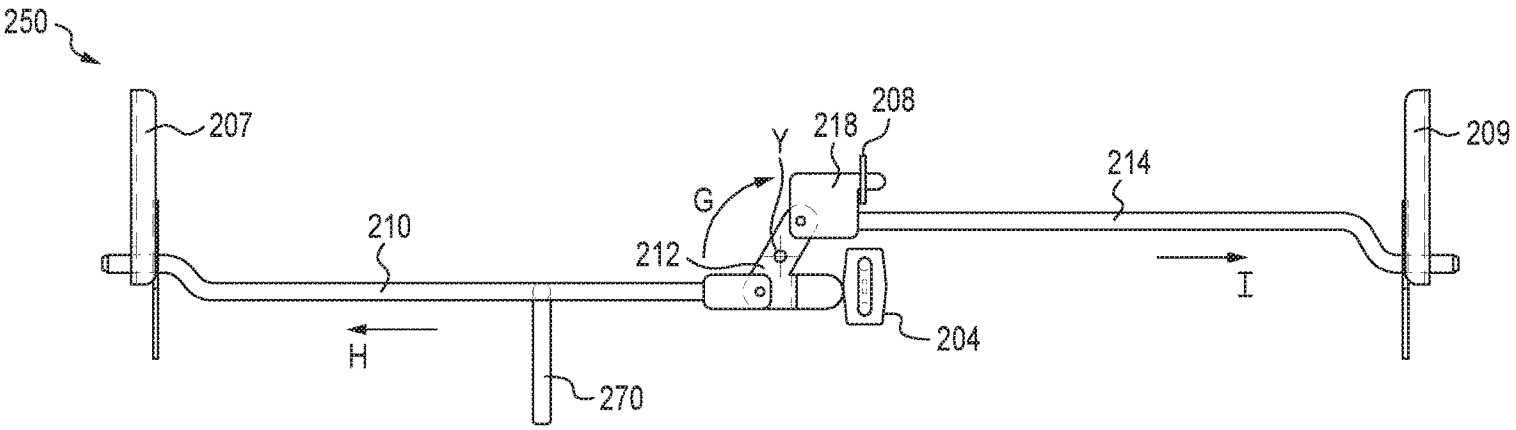
FIGS. 15 and 16 are schematic front and top views respectively, of the system of FIG. 14, in a locked position.
Figure 16:
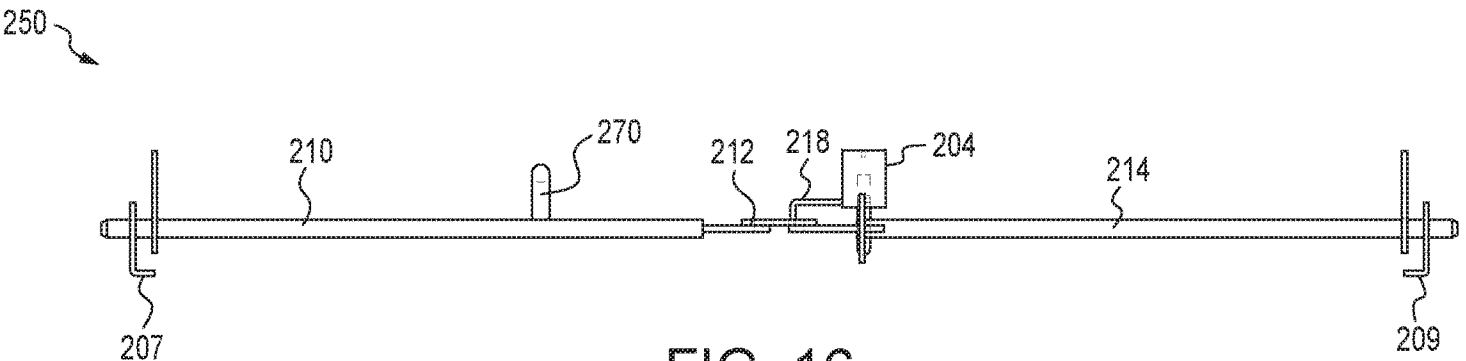
Figure 17:
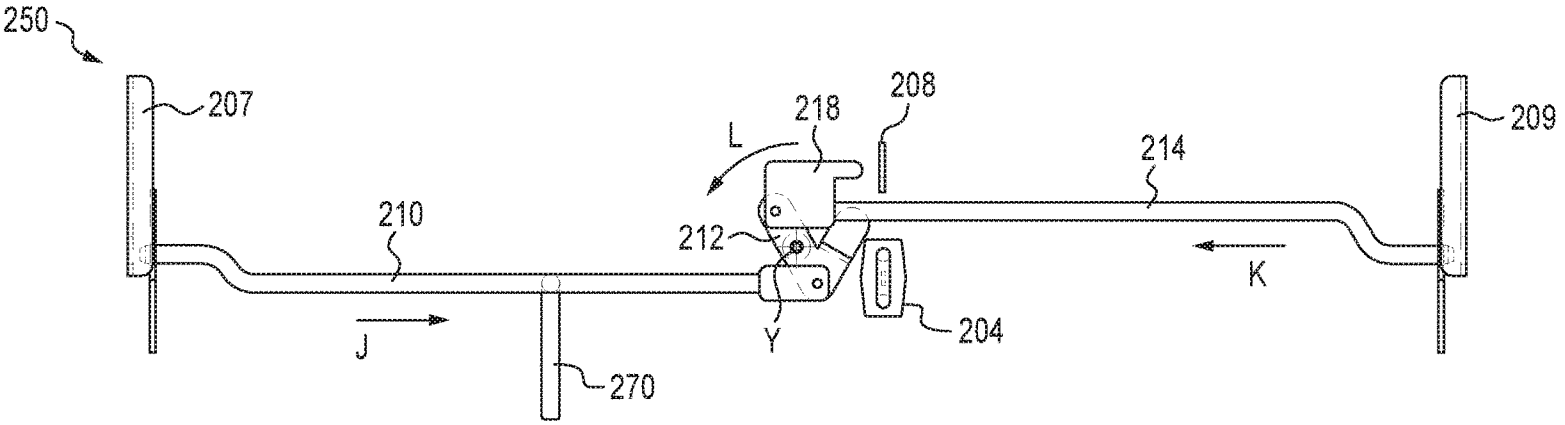
FIGS. 17 and 18 are schematic front and top views respectively, of the system of FIG. 14, in an unlocked position.
Figure 18:
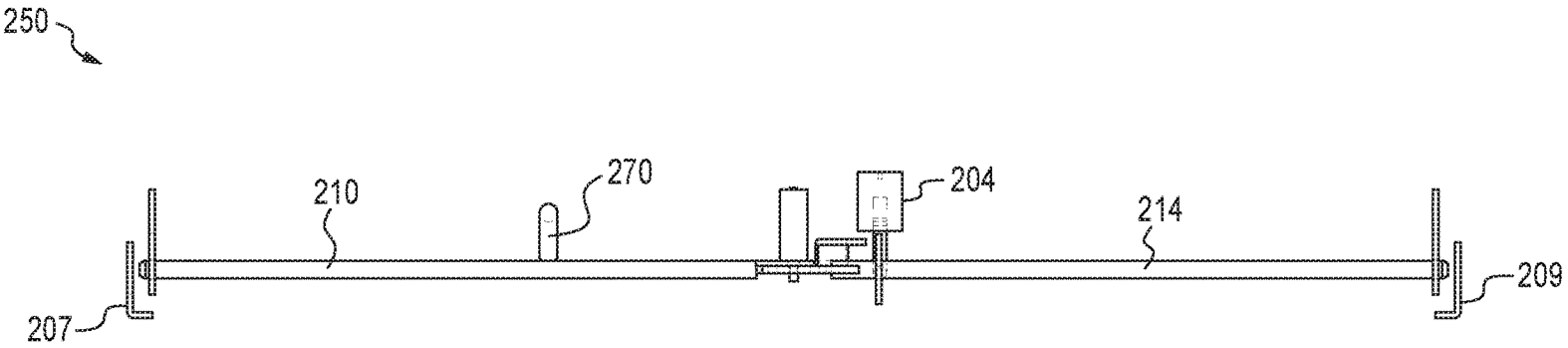

FIGS. 15 and 16 illustrate the locking system 250 in a locked position. And, FIGS. 17 and 18 show the locking system 250 in an unlocked position. The actuator 212 is rotatable about axis Y and typically about a support member 260. Upon longitudinal movement of the first slide bar 210 in the direction of arrow H, the actuator 212 is rotated about axis Y in the direction of arrow G. The tang 218 which is coupled to the actuator 212, is urged into engagement with a catch bracket 208 which for example is affixed or formed with a lid (not shown) or moveable panel of the chest 202.

Rotational movement of the actuator 212 about axis Y in the direction of arrow G also results in corresponding longitudinal movement of the second slide bar 214 in the direction of arrow I. As will be appreciated by reference to FIG. 15, upon the noted movements, a distal end of slide bar 210 is urged into engagement with a flange 207 of the chest 202, and a distal end of slide bar 214 is urged into engagement with a flange 209 of the chest 202. One or both flanges 207, 209 are affixed or formed with the lid (not shown) or moveable panel of the chest 202.

The present embodiment differs from the previously described locking systems by the use of a handle member 270 which is linearly displaced or moved to cause linear displacement of the slide bar 210 which in turn causes rotation of the actuator 212. Although the referenced figures depict the handle 270 as affixed to or extending from the first slide bar 210, the present subject matter includes the handle 270 affixed or extending from the second slide bar 214. In addition, the present subject matter includes the use of multiple handles such as two linearly displaceable handles, each extending from a corresponding slide bar. And, the subject matter includes the use of a rotationally displaceable handle such as provided with the actuator in combination with one or more linearly displaceable handles.

The chest 202 typically defines an opening 255 through which the handle 270 extends. The opening 255 is sized and shaped to enable a user to linearly displace the handle 270 from the exterior of the chest 202 and thereby lock or unlock the system 250.

FIGS. 17 and 18 illustrate unlocking of the system 250. The handle 270 and the first slide bar 210 are linearly displaced in the direction of arrow J. Such movement results in disengagement of the distal end of the first slide bar 210 from the flange 207, and partial rotation of the actuator 212 in the direction of arrow L about axis Y. Such movement results in disengagement of the tang 218 from the catch bracket 208 and linear displacement of the second slide bar 214 in the direction of arrow K. Such movement of the slide bar 214 results in disengagement of the distal end of the slide bar 214 from the flange 209.

Figure 19:
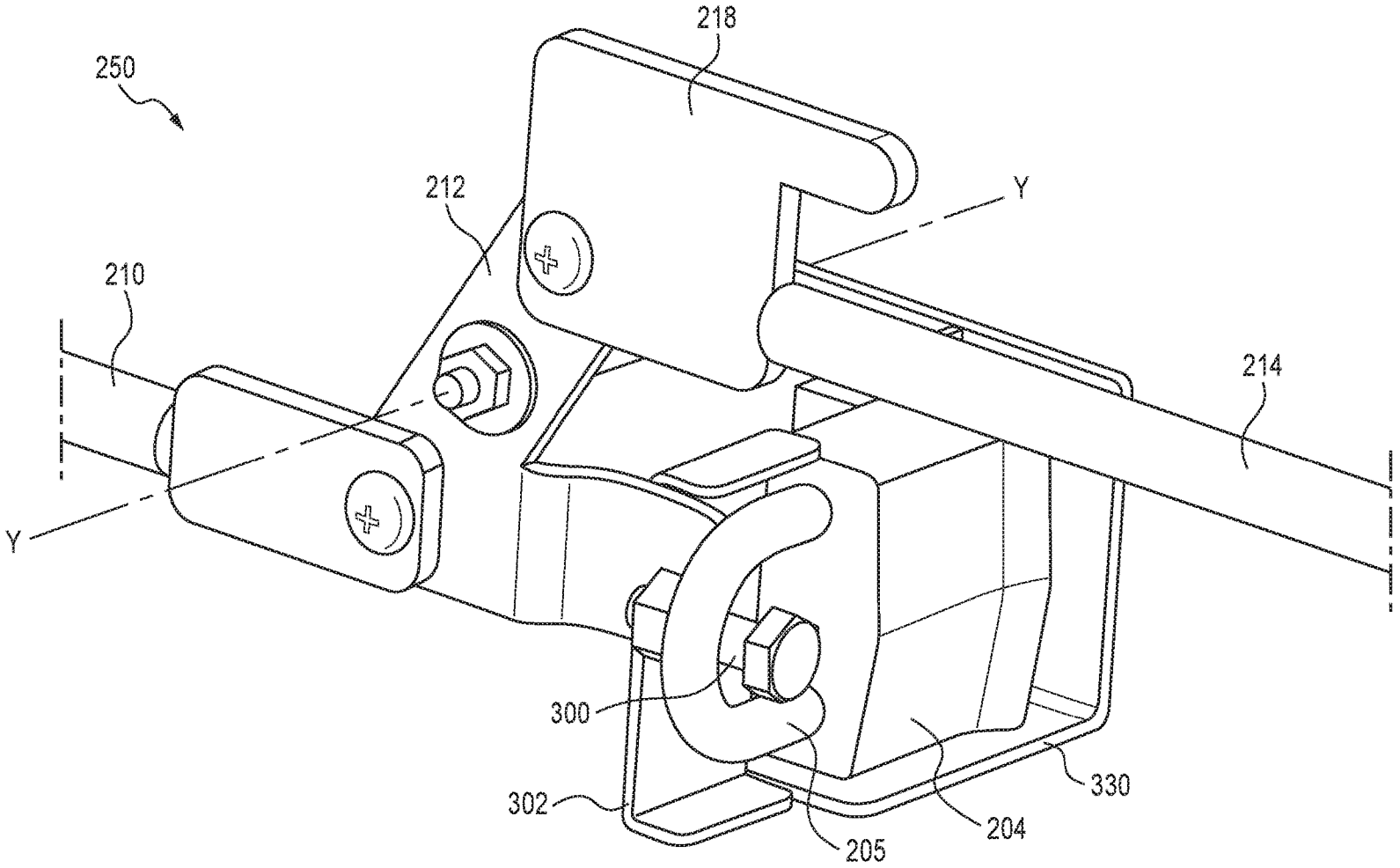
FIGS. 19 and 20 are schematic perspective views of the locking system of FIG. 14.
Figure 20:
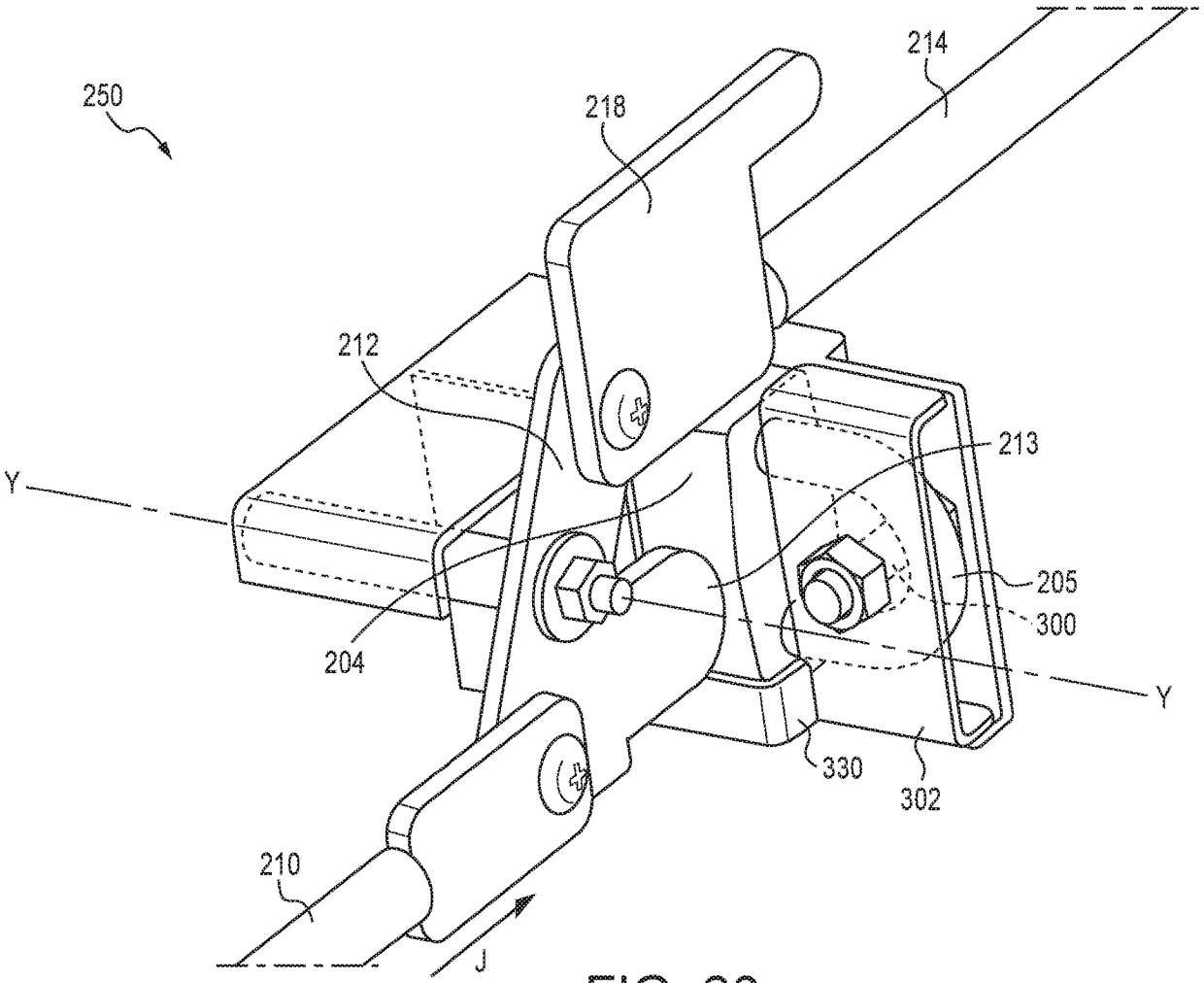

FIGS. 19 and 20 further illustrate the locking system 250 used in conjunction with a padlock 204 having a shank 205. The padlock 204 is generally housed and retained within a chamber 330 as previously described. The shank 205 is retained by an engagement member 300 which is affixed to a stationary member 302 which for example extends from the chest 202 or interior face thereof. Upon the padlock 204 being in a locked or "closed" state, the body of the padlock 204 is positioned such that a finger 213 of the actuator 212 is blocked from rotational motion or other limited in its movement upon displacement of the first slide bar 210 in the direction of arrow J, which would be necessary in order to unlock the system 250. After unlocking the padlock 204, the body of the padlock moves away from the stationary shank 204, thereby enabling the finger 213 to be rotatably positioned within the space between the body of the padlock and the shank 205.

The various locking systems and lockable enclosures have been described with reference to padlocks that can be selectively locked and unlocked. Typically, such padlocks are locked or unlocked by a separate key which is inserted into the main body of the padlock. The padlocks typically include a U-shaped shackle which upon unlocking of the padlock, can be moved so as to allow access to one end of the shackle. The other end of the U-shaped shackle is permanently affixed to the main body of the padlock. A wide range of padlock sizes can be used such as body widths of from about 1½ inch to about 2½ inch, and a shackle length of from about ¾ inch to about 6 inches, in which the shackle length is measured from the top of the padlock body to the inside surface of the "U" portion of the shackle when the padlock is in a locked position. Generally, the chamber or weldment is sized to fittingly receive the padlock so that the walls of the chamber are located close to the padlock body so that the padlock is protected from cutting tools or torches. However, it will be understood that in no manner is the present subject matter limited to any of these padlock types and/or sizes.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A lockable enclosure comprising:

an enclosure defining an opening providing access to an interior of the enclosure, the enclosure including a panel movably affixed to the enclosure and selectively positionable over the opening to govern access to the interior, and a chamber sized and shaped to fittingly receive a padlock;

a locking system including a rotatable actuator and a sliding bolt engaged with the actuator such that upon one of (i) at least partial rotation of the actuator, and (ii) longitudinal displacement of the sliding bolt, the other of (i) and (ii) occurs;

the locking system being positionable between a locked position and an unlocked position, wherein at the locked position the sliding bolt engages the enclosure and the panel and prevents selective positioning of the panel to preclude access to the interior of the enclosure, and at the unlocked position the sliding bolt is free from engagement with at least one of the enclosure and the panel to allow access to the interior of the enclosure;

wherein (i) upon placement of an unlocked padlock in the chamber, (ii) positioning the locking system to the locked position, and (iii) locking the padlock, the locking system is precluded from being positioned to an unlocked position due to contact between the rotatable actuator and the padlock.

2. The lockable enclosure of claim 1 wherein rotation of the actuator is blocked by a body of the padlock.

3. The lockable enclosure of claim 1 wherein the sliding bolt of the locking system is a first sliding bolt, the locking system further including a second sliding bolt engaged with the actuator such that upon one of (i) and (ii), the second sliding bolt is longitudinally displaced.

4. The lockable enclosure of claim 3 wherein upon at least partial rotation of the actuator, the second sliding bolt moves in a direction opposite a direction of movement of the first sliding bolt.

5. The lockable enclosure of claim 1 wherein the actuator includes a finger, and upon positioning the locking system to a locked position, the finger engages the panel to further prevent selective positioning of the panel.

6. The lockable enclosure of claim 5 wherein the positioning of the locking system to the locked position occurs by rotating the actuator.

7. The lockable enclosure of claim 1 wherein the sliding bolt includes an engagement member configured to engage the panel when the panel is positioned over the opening of the enclosure and the locking system positioned to the locked position.

8. The lockable enclosure of claim 1 wherein the sliding bolt is a first sliding bolt and the locking system further includes a second sliding bolt, wherein upon longitudinal movement of at least one of the first and second sliding bolts, the actuator undergoes at least partial rotation.

9. The lockable enclosure of claim 8 wherein the locking system further includes a handle affixed to at least one of the first and second sliding bolts.

10. The lockable enclosure of claim 1 wherein the rotatable actuator is rotated between an unlocked position and a locked position by rotational motion of a rotatable handle.

11. The lockable enclosure of claim 10 wherein the rotatable handle is accessible from an exterior of the enclosure through an opening in a wall of the enclosure.

12. A lockable enclosure comprising:

an enclosure having a frame member and defining an interior and an opening providing access to the interior of the enclosure;

a panel having an engagement member, the panel movably affixed to the enclosure and positionable between (i) a closed position in which the panel blocks access through the opening to the interior of the enclosure, and (ii) an open position in which the interior of the enclosure can be accessed through the opening;

the frame member of the enclosure defining a first aperture;

the engagement member of the panel defining a second aperture;

a locking system including:

an actuator rotatable about a center axis, the actuator defining a first end and a second end such that the center axis is located between the first end and the second end, the actuator including a tang extending outwardly from the actuator and a finger projecting from the actuator in a direction generally opposite from the tang, both the tang and the finger disposed proximate the first end of the actuator;

a sliding bolt affixed to the actuator and engageable with the frame member of the enclosure and the engagement member of the panel;

the locking system being positionable between a locked position and an unlocked position, wherein at the locked position the actuator is rotatably positioned such that the sliding bolt extends through both of the first aperture defined in the frame member and the second aperture defined in the engagement member, and at the unlocked position the actuator is rotatably positioned such that the sliding bolt is free from at least one of the first aperture and the second aperture.

13. The lockable enclosure of claim 12 wherein at the locked position, the finger engages a second engagement member of the panel.

14. The lockable enclosure of claim 12 further comprising a chamber sized and shaped to fittingly receive a padlock, the chamber located proximate the actuator.

15. The lockable enclosure of claim 14 wherein the chamber is located proximate the actuator such that upon unlocking of the padlock disposed in the chamber, and positioning of the locking system to the unlocked position, the tang of the actuator is disposed between a shackle of the padlock and a body of the padlock.

16. The lockable enclosure of claim 15 wherein upon locking of the padlock disposed in the chamber and positioning of the locking system to the locked position, the tang is free from a region between the shackle of the padlock and the body of the padlock.

17. The lockable enclosure of claim 16 wherein the locking system is precluded from positioning to the unlocked position unless the padlock is unlocked.

18. The lockable enclosure of claim 17 wherein the locking system is precluded from positioning to the unlocked position due to the tang of the actuator contacting the body of the padlock.

19. The lockable enclosure of claim 12 wherein the sliding bolt is a first sliding bolt and the locking system further includes:

a second sliding bolt affixed to the actuator and engageable with the enclosure and the panel.

20. The lockable enclosure of claim 19 wherein the frame member of the enclosure is a first frame member and the engagement member of the panel is a second engagement member, the enclosure further having a second frame member defining a third aperture, and the panel further having a second engagement member defining a fourth aperture, wherein at the locked position of the locking system, the second sliding bolt extends through both of the third aperture defined in the second frame member and the fourth aperture defined in the second engagement member.

21. The lockable enclosure of claim 12 wherein the sliding bolt includes an engagement member configured to engage the panel when the panel is positioned over the opening of the enclosure and the locking system positioned to the locked position.

22. The lockable enclosure of claim 19 wherein the locking system further includes a handle affixed to at least one of the first and second sliding bolts.

23. The lockable enclosure of claim 22 wherein the rotatable handle is accessible from an exterior of the enclosure through an opening in a wall of the enclosure.

24. A locking system comprising:

a rotatable actuator;

a sliding bolt engaged with the actuator such that upon partial rotation of the actuator, the sliding bolt is longitudinally displaceable between an extended position and a retracted position;

a chamber sized and shaped to fittingly receive a padlock, the chamber positioned proximate the actuator;

the locking system being positionable between a locked position and an unlocked position, wherein at the locked position the sliding bolt is longitudinally positioned to the extended position, and at the unlocked position the sliding bolt is longitudinally positioned to the retracted position;

wherein (i) upon placement of an unlocked padlock in the chamber, (ii) positioning the locking system to the locked position, and (iii) locking the padlock, the locking system is precluded from being positioned to an unlocked position due to contact between the rotatable actuator and the padlock.

25. The locking system of claim 24 wherein upon (i), (ii), and (iii), the locking system is precluded from being positioned to an unlocked position due to rotary contact between the actuator and the padlock.

26. The locking system of claim 24 wherein the sliding bolt is a first sliding bolt, the locking system further comprises:

a second sliding bolt engaged with the actuator such that upon partial rotation of the actuator, the second sliding bolt is longitudinally displaceable between an extended position and a retracted position, the second sliding bolt moves in a direction opposite a direction of movement of the first sliding bolt.

27. The locking system of claim 24 wherein the sliding bolt is a first sliding bolt and the locking system further comprises a second sliding bolt, wherein upon longitudinal movement of at least one of the first and second sliding bolts, the actuator undergoes at least partial rotation.

28. The locking system of claim 27 further comprising:

a handle affixed to at least one of the first and second sliding bolts.

29. The locking system of claim 24 wherein the padlock is secured in the chamber by positioning a member through a shackle of the padlock to thereby frictionally engage the shackle between the member and a wall of the chamber.

30. The locking system of claim 29 wherein the member includes an eccentric cam portion and the shackle is frictionally engaged with the wall of the chamber by rotating the member.

31. The locking system of claim 30 wherein the member includes a threaded position and a jam nut, such that upon tightening the jam nut the member is secured to thereby securely position the shackle against the wall of the chamber.

32. The locking system of claim 24 wherein the locking system further comprises a rotatable handle engaged with the rotatable actuator.

* * * * *